US007762074B2

(12) United States Patent
Bland et al.

(10) Patent No.: US 7,762,074 B2
(45) Date of Patent: Jul. 27, 2010

(54) AIR FLOW CONDITIONER FOR A COMBUSTOR CAN OF A GAS TURBINE ENGINE

(75) Inventors: Robert J. Bland, Oviedo, FL (US); John Battaglioli, Glenville, NY (US); Anil Gulati, Winter Springs, FL (US); Stephen Ramier, Burlington (CA)

(73) Assignee: Siemens Energy, Inc., Orlando, FL (US)

( * ) Notice: Subject to any disclaimer, the term of this patent is extended or adjusted under 35 U.S.C. 154(b) by 1149 days.

(21) Appl. No.: 11/397,364

(22) Filed: Apr. 4, 2006

(65) Prior Publication Data

US 2007/0227148 A1 Oct. 4, 2007

(51) Int. Cl.
*F02C 1/00* (2006.01)
*F02G 3/00* (2006.01)

(52) U.S. Cl. ..... 60/752; 60/754; 60/760

(58) Field of Classification Search ..... 60/39.37, 60/737, 754, 734, 804, 39.23, 752, 760; 431/242, 431/243, 352; 137/561 A; 239/428.5, 370
See application file for complete search history.

(56) References Cited

U.S. PATENT DOCUMENTS 2,654,219 A * 10/1953 Tadeusz Zaba ..... 60/752
5,611,684 A * 3/1997 Spielman ..... 431/353
6,047,903 A 4/2000 Meyer
6,093,018 A * 7/2000 Avshalumov ..... 431/352
6,295,803 B1 * 10/2001 Bancalari ..... 60/39.511
6,427,446 B1 * 8/2002 Kraft et al. ..... 60/737
6,438,961 B2 8/2002 Tuthill et al.
6,594,999 B2 7/2003 Mandai et al.
6,634,175 B1 10/2003 Kawata et al.
6,640,545 B2 * 11/2003 Ruck et al. ..... 60/737
6,701,963 B1 3/2004 Hill
6,832,482 B2 * 12/2004 Martling et al. ..... 60/737
6,848,260 B2 * 2/2005 North et al. ..... 60/737
6,920,758 B2 7/2005 Matsuyama et al.
7,080,515 B2 * 7/2006 Wasif et al. ..... 60/737
7,096,675 B2 * 8/2006 Jonsson et al. ..... 60/794
7,513,098 B2 * 4/2009 Ohri et al. ..... 60/39.11
7,574,865 B2 * 8/2009 Bland ..... 60/752
2003/0058737 A1 3/2003 Berry et al.
2004/0206082 A1 10/2004 Martin et al.
2008/0010991 A1 * 1/2008 Johnson et al. ..... 60/772

FOREIGN PATENT DOCUMENTS

GB 588086 * 5/1947

* cited by examiner

*Primary Examiner*—Michael Cuff
*Assistant Examiner*—Young Choi

(57) ABSTRACT

A burner (27) of a gas turbine engine (10) includes a cylindrical basket (60) comprising an air flow reversal region (86). The flow reversal region ends at an air inlet plane (84) of the basket. The burner also includes a flow conditioner (90) disposed in the flow reversal region transecting an air flow (80) flowing non-uniformly through the flow reversal region, the flow conditioner being effective to mitigate variation of the air flow entering the basket across the inlet plane.

18 Claims, 4 Drawing Sheets

AIR FLOW CONDITIONER FOR A COMBUSTOR CAN OF A GAS TURBINE ENGINE

FIELD OF THE INVENTION

The present invention relates generally to gas turbine engines, and, more particularly, to controlling airflow among premixers of a main burner of a combustor can.

BACKGROUND OF THE INVENTION

Gas turbines having can-annular combustors are known wherein individual cans, including a combustion zone within the can, feed hot combustion gas into respective individual portions of an arc of a turbine inlet. Each can may include a main burner having a plurality of premixers, such as swirlers, disposed in a ring around a central pilot burner for premixing fuel and air. The premixers receive respective portions of a flow of compressed air being conducted to the premixers with respective portions of a fuel flow. The respective portions of the fuel flow are discharged by fuel outlets disposed within the premixers to form an air/fuel mixture for combustion in the downstream combustion zone.

BRIEF DESCRIPTION OF THE DRAWINGS

The invention is explained in following description in view of the drawings that show.

DETAILED DESCRIPTION OF THE INVENTION

Combustor cans of gas turbine engines may suffer from uneven or non-uniform airflows being conducted within the can among the premixers of the can. For example, in dry, low NOx (DLN) burners it has been experimentally determined that air flow rates through respective premixers of the main burner of the can may vary by as much as 7.5% from an average flow rate among the premixers. Such a variation may create temperature differentials of +/−75 degrees centigrade among the premixers when operating the gas turbine is operating at base load. These temperature differentials may result in more NOx production by the relatively hotter areas of the burner associated with premixers receiving a relatively higher than average air flow and more CO production by the relatively cooler areas of the burner associated with premixers receiving relatively less than average air flow. It would be beneficial to ensure that all premixers of the main burner operate within a narrower temperature range to reduce emissions and a need for aggressive piloting that may be required to stabilize the cooler burning areas of the burning. The inventors of the present invention have innovatively realized that by mitigating airflow differences among premixers in a combustor can, improved combustion characteristics, such as reduced emissions, may be achieved.

Figure 1:
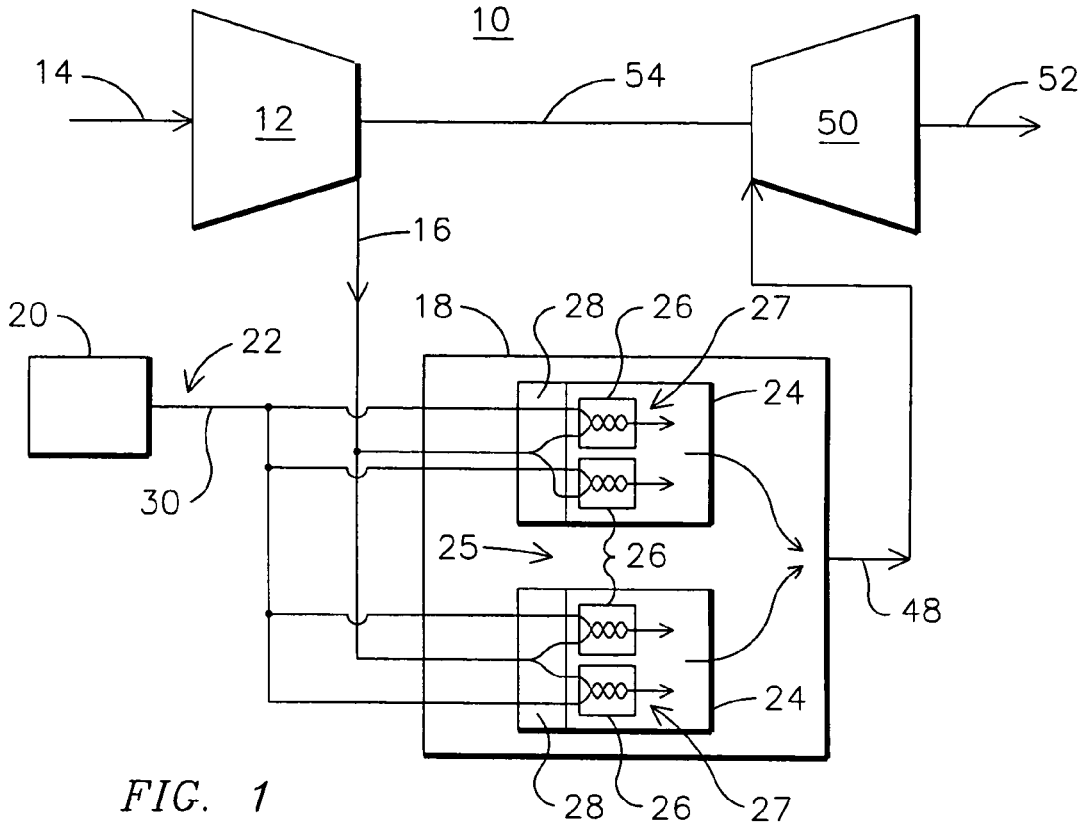
FIG. 1 is a functional diagram of an exemplary embodiment of a gas turbine engine configured for mitigating air flow variation in a combustor of the gas turbine engine.

FIG. 1 shows a gas turbine engine 10 including a compressor 12 for receiving ambient air 14 and for providing compressed air 16 to a combustor 18. In an aspect of the invention, the combustor 18 is a can annular type combustor comprising a plurality of combustor cans 24 annularly disposed about a central region 25, each can comprising a plurality of premixers 26 annularly disposed to form a main burner 27 of the can 24. The combustor 18 also receives combustible fuel 30, for example, from a fuel supply 20 along a fuel flow path 22. Respective portions of the fuel supply 20 are delivered to each the burners 27 of the cans 24. In an aspect of the invention, one or more cans 24 may include an air flow conditioner 28 receiving respective portions of the compressed air 16 for mitigating airflow variation among the premixers 26 of the burner 27.

Combustion of the combustible fuel 30 supplied to the combustor 18 in the compressed air 16 results in the supply of hot combustion gas 48 to turbine 50, wherein the hot combustion gas 48 is expanded to recover energy in the form of the rotation of shaft 54 that is used, in turn, to drive the compressor 12. The turbine exhaust 52 is delivered back to the ambient atmosphere.

Figure 2:
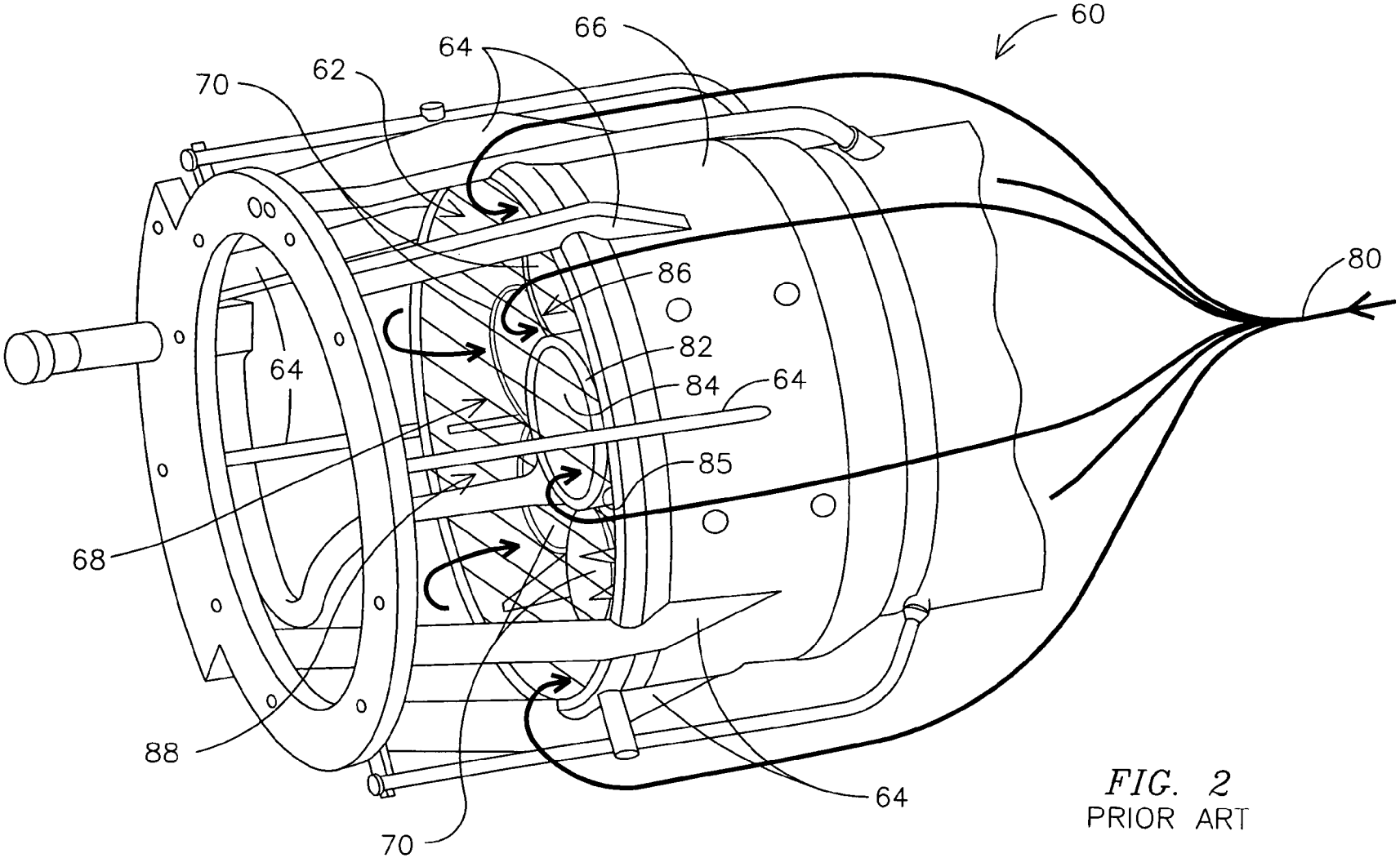
FIG. 2 PRIOR ART
FIG. 2 is a partial isometric view of a prior art combustor basket of a dry, low NOx (DLN) burner.

FIG. 2 is a partial isometric view of a prior art cylindrical combustor basket 60 of a DLN burner. The combustor basket 60 comprises a head end, or upstream air inlet portion 62, defined by a plurality of spaced apart basket arms 64 and a downstream tubular portion 66 defining an air flow path 68 around a plurality of premixers 70 annularly disposed within the downstream tubular portion 66 around a pilot burner 82. The combustor basket 60 receives an air flow 80 that is typically non-uniformly distributed circumferentially around the inlet 62 and conducts the air flow 80 to the plurality of premixers 70 and pilot burner 82. As the air flow 80 enters the inlet portion 62, it makes a flow reversing, 180 degree turn in a flow reversal region 86 that ends at an air inlet plane 84 (indicated by cross-hatching) of the basket 60 at a junction 85 of the upstream air inlet portion 62 and the downstream tubular portion 66. The abrupt turning of the air flow 80 in the flow reversal region 86 results in a pressure loss of the air flow 80. As described earlier, a non-uniform distribution of the air flow 80 typically results in uneven burning in the main burner, resulting in increased emissions formation than if the burner were provided more evenly distributed air.

Figure 3:
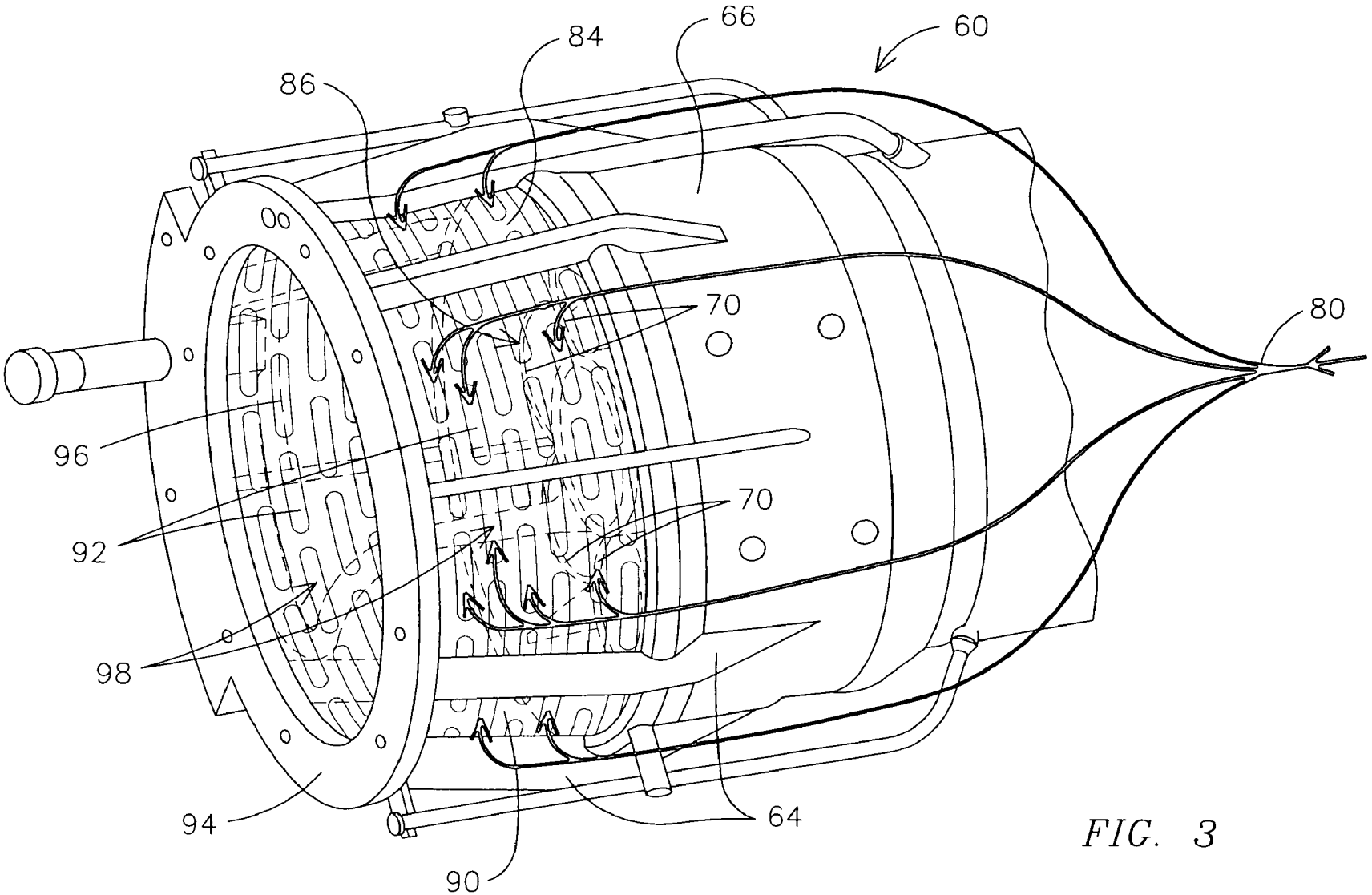
FIG. 3 is a partial isometric view of a combustor basket of a DLN burner including a flow conditioner.

FIG. 3 is a partial isometric view of a combustor basket 60 of a DLN burner including a flow conditioner 90 disposed in the flow reversal region 86 to mitigate variation of the air flow 80 entering the downstream tubular portion 66 an inlet plane 84 and flowing among the premixers 70. In an embodiment, the flow conditioner 90 comprises a generally annular shape and includes a plurality of perforations, such as slots 92, allowing portions of the air flow 80 to flow therethrough. The slots 92 may be arranged in spaced apart, circumferentially aligned rows 98 so that each slot 92 includes a longitudinal axis 96 oriented parallel with the inlet plane 84. Slots 96 in adjacent rows 98 may be offset from one another. The annular shape of the flow controller 90 may be in the form of a conic frustum sized to fit radially inward of the spaced apart basket arms 64 and extend from an end 94 of the basket 60 to the inlet plane 84. The flow controller 90 may be secured to the basket 60 using, for example, bolts or welds. In another embodiment, the flow controller 90 may comprise a plurality of perforated plates disposed between adjacent spaced apart basket arms 64, each plate extending from the end 94 of the basket 60 to the air inlet plane 84.

Figure 4:
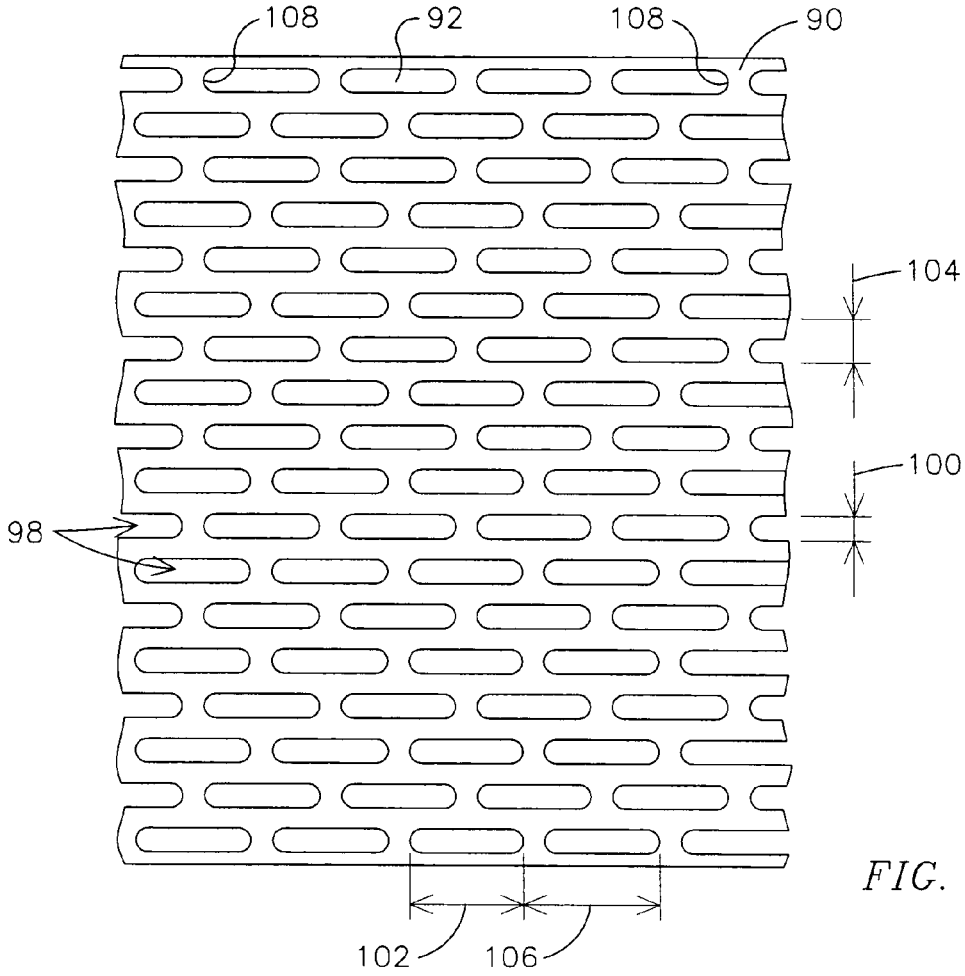
FIG. 4 is partial view of an exemplary flow conditioner.

FIG. 4 is a partial view of an exemplary flow controller 90 showing details of slot 92 geometry. A ratio of the slot width 100 to slot length 102 may be in the range of about 0.1 to 0.3. A ratio of the spacing 104 between adjacent rows 98 to a slot width 100, or an axial pitch 104 ratio, may be in range of about 0.7 to 0.8. A ratio of the spacing between adjacent slots 92 in a row 98 to a slot length 102, or a circumferential pitch 106 ratio, may be in range of about 0.1 to 0.2. The slots 92 may include a round geometry at slot 108 ends for example, to inhibit crack formation compared to a square geometry. In an aspect of the invention, a ratio of a total slot area of the flow controller 90 to a total surface area of the flow controller 90 may be in the range of about 0.4 to 0.6, and more preferably in the range of about 0.42 to 0.5.

Figure 5:
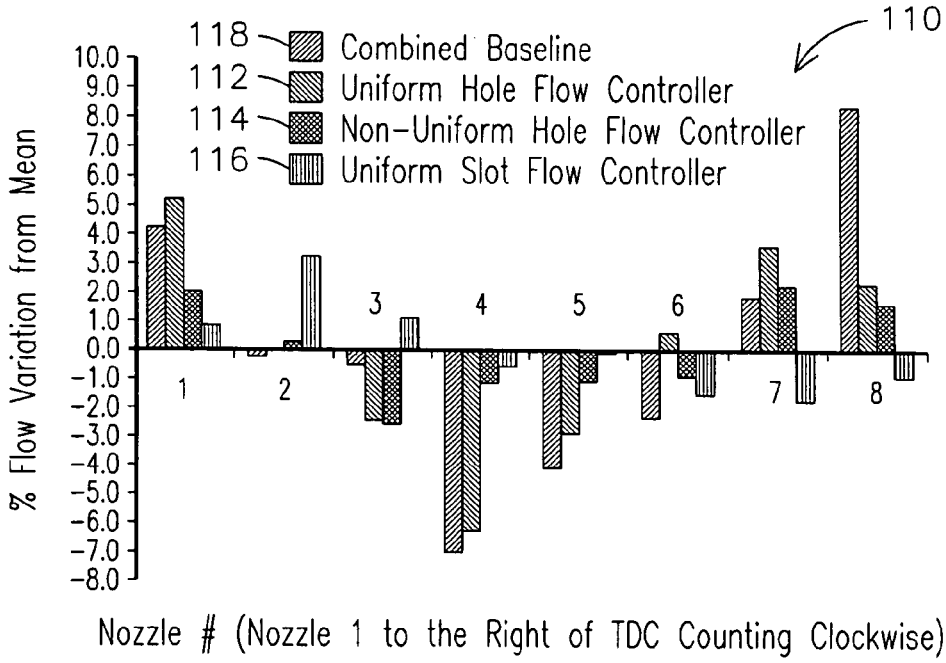
FIG. 5 is a graph showing mitigation of air flow variation among premixers of a DLN burner using exemplary flow conditioner models.

FIG. 5 is a graph 110 showing mitigation of flow variation among premixers of a DLN burner based on a flow simulation of a flow conditioner disposed in the flow reversal region. The DLN burner includes eight annular premixers, the flow being measured at nozzles of the premixers. Flow variation simulation results for a flow controller comprising uniform sized circular holes 112, a flow controller comprising non-uniform sized circular holes 114, and a flow controller comprising uniform sized slots 116 are depicted. As shown in the graph 110, a baseline 118 flow variation with no flow controller varies from +8.3% to −7.5% of a mean, the flow controller comprising uniform sized circular holes 112 exhibited a flow variation of +5.1% to −6.3% of the mean, the flow controller comprising non-uniform sized circular holes 114 exhibited a flow variation of +2.2% to −2.6%, and the flow controller comprising uniform sized slots exhibited a flow variation of +3.2% to −1.8%. Although circular holes may mitigate flow variation, the inventors have experimentally determined that circular holes result in an undesirable pressure drop of the air flow flowing therethrough. Additionally, even if the size of the circular holes are varied to correspond to an impinging air flow profile to improve air flow distribution downstream of the flow controller, if the impinging air flow profile varies slightly, as may occur from can to can in a can annular combustor, the flow variation mitigation performance of the plate degrades undesirably.

Figure 6:
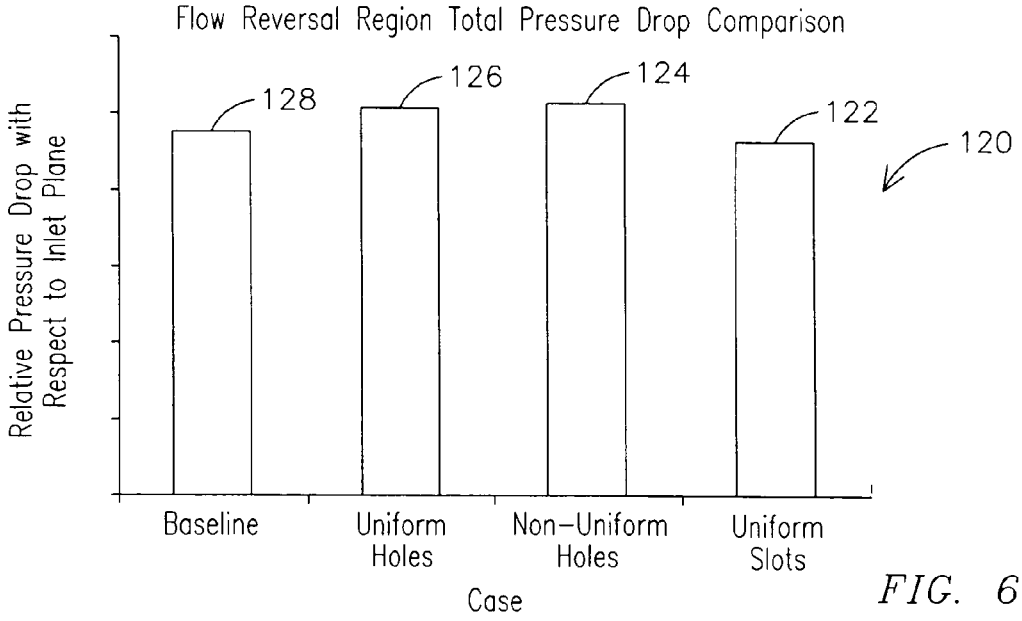
FIG. 6 is a graph showing flow reversal region pressure drop percentages for exemplary air flow conditioner models.

In another aspect of the invention, it has been experimentally demonstrated that a flow conditioner disposed in the flow reversal region and having slotted holes, as opposed, for example, to circular holes, is effective to mitigate air flow variations while achieving no net air flow loss compared to not having the air flow conditioner disposed in the flow reversal region. For example, as shown in the graph 120 of FIG. 6, a predicted air flow pressure drop 122 at the inlet plane of a simulated slotted air flow conditioner is less than the pressure drops 124, 126 for simulated flow conditioners having a uniform and non-uniform, respectively, circular hole configurations and results in no net pressure loss, and may be slightly better, than having no air flow conditioner disposed in the flow reversal region as indicated by baseline pressure drop 128.

While various embodiments of the present invention have been shown and described herein, such embodiments are provided by way of example only. Numerous variations, changes and substitutions may be made without departing from the invention herein. Accordingly, it is intended that the invention be limited only by the spirit and scope of the appended claims.

We claim:

1. A burner of a gas turbine engine comprising:

a cylindrical basket comprising an air flow reversal region, the flow reversal region being disposed upstream of a fuel mixing region and ending at an air inlet plane of the basket; and a flow conditioner comprising a plurality of slots disposed in the flow reversal region transecting an air flow flowing non-uniformly through the flow reversal region, wherein the air flow flows through the slots, the flow conditioner being effective to mitigate variation of the air flow entering the basket across the inlet plane and to reduce a pressure drop across the flow conditioner when compared to a flow conditioner comprising a plurality of round holes, and wherein the flow conditioner comprises a perforated plate comprising a conic frustum shape.

2. The burner of claim 1, wherein the flow conditioner comprises a plurality of perforated plates disposed edge-to-edge between adjacent spaced apart legs connecting an end of the basket to an air inlet plane portion of the basket.

3. The burner of claim 1, wherein the slots comprise a longitudinal axis oriented parallel with the inlet plane.

4. The burner of claim 1, wherein the slots comprises a slot width to a slot length ratio ranging from about 0.1 to 0.3.

5. The burner of claim 1, wherein the slots are arranged in axially spaced apart, circumferential rows around the conic frustum shape.

6. The burner of claim 5, wherein a spacing between adjacent circumferential rows to a slot width ratio ranges from about 0.7 to 0.8.

7. The burner of claim 5, wherein a spacing between adjacent slots in a circumferential row to a slot length ratio ranges from about 0.1 to 0.2.

8. The burner of claim 1, the flow controller comprising a plurality of openings, wherein a ratio of a total opening area of the flow controller to a total surface area of the flow controller ranges from about 0.4 to 0.6.

9. The burner of claim 8, wherein the ratio of the total opening area of the flow controller to the total surface area of the flow controller ranges from about 0.42 to 0.5.

10. A burner of a gas turbine engine comprising: a cylindrical basket comprising an air flow reversal region, the flow reversal region being disposed upstream of a fuel mixing region and ending at an air inlet plane of the basket; and a flow conditioner comprising a plurality of slots disposed in the flow reversal region transecting an air flow flowing non-uniformly through the flow reversal region, wherein the air flow flows through the slots, the flow conditioner being effective to mitigate variation of the air flow entering the basket across the inlet plane and to reduce a pressure drop across the flow conditioner when compared to a flow conditioner comprising a plurality of round holes, and wherein the slots comprise a longitudinal axis oriented parallel with the inlet plane.

11. The burner of claim 10, wherein the flow conditioner comprises a generally annular shape.

12. The burner of claim 11, wherein the flow conditioner comprises a plurality of slots arranged in axially spaced apart, circumferential rows around the generally annular shape.

13. The burner of claim 12, wherein a spacing between adjacent circumferential rows to a slot width ratio ranges from about 0.7 to 0.8.

14. The burner of claim 12, wherein a spacing between adjacent slots in a circumferential row to a slot length ratio ranges from about 0.1 to 0.2.

15. The burner of claim 10, wherein the flow conditioner comprises a plurality of perforated plates disposed edge-to-edge between adjacent spaced apart legs connecting an end of the basket to an air inlet plane portion of the basket.

16. The burner of claim 10, wherein the slots comprises a slot width to a slot length ratio ranging from about 0.1 to 0.3.

17. The burner of claim 10, the flow controller comprising a plurality of openings, wherein a ratio of a total opening area of the flow controller to a total surface area of the flow controller ranges from about 0.4 to 0.6.

18. The burner of claim 17, wherein the ratio of the total opening area of the flow controller to the total surface area of the flow controller ranges from about 0.42 to 0.5.

* * * * *